US008167653B2

(12) United States Patent
Hasegawa et al.

(10) Patent No.: US 8,167,653 B2
(45) Date of Patent: May 1, 2012

(54) SHIELD SHELL

(75) Inventors: Kiyoshi Hasegawa, Yokkaichi (JP); Sho Miyazaki, Yokkaichi (JP); Fujio Sonoda, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 385 days.

(21) Appl. No.: 12/449,542

(22) PCT Filed: Feb. 29, 2008

(86) PCT No.: PCT/JP2008/053668

§ 371 (c)(1),
(2), (4) Date: Aug. 13, 2009

(87) PCT Pub. No.: WO2008/108300

PCT Pub. Date: Sep. 12, 2008

(65) Prior Publication Data

US 2010/0046189 A1 Feb. 25, 2010

(30) Foreign Application Priority Data

Mar. 2, 2007 (JP) ..... 2007-053069

(51) Int. Cl.
*H01R 9/03* (2006.01)

(52) U.S. Cl. ..... 439/607.41

(58) Field of Classification Search ..... 439/607.41, 439/607.44, 34
See application file for complete search history.

(56) References Cited

U.S. PATENT DOCUMENTS 6,270,377 B1 * 8/2001 Miyazaki et al. ..... 439/607.41
6,464,538 B2 * 10/2002 Miyazaki et al. ..... 439/607.44
6,945,817 B2 * 9/2005 Miyazaki et al. ..... 439/579

FOREIGN PATENT DOCUMENTS

JP A-7-335324 12/1995
JP A 7-335324 12/1995
JP A-10-241792 9/1998
JP A 10-241792 9/1998

OTHER PUBLICATIONS

Office Action issued in Japanese Patent Application No. 2009-502561 dated Aug. 2, 2011 (with translation).
Office Action issued in Chinese Patent Application No. 200880006786.0 dated Apr. 8, 2011 (with Translation).

* cited by examiner

*Primary Examiner* — Javaid Nasri
(74) *Attorney, Agent, or Firm* — Oliff & Berridge, PLC

(57) ABSTRACT

A shield shell is composed of a tubular shell body made of a conductive resin and a metallic conductive body mounted in the shell body. The conductive body is capable of, in the base end part, connecting with a shielding member by being exposed on the surface of the shell body, while in the tip part, connecting with a shield case by being exposed on the surface of the shell body. The shielding member and the shield case are connected via the metallic conductive body of a low electric resistance, and thereby achieving excellent shielding performance in a low-frequency region in the shield shell.

5 Claims, 11 Drawing Sheets

SHIELD SHELL

TECHNICAL FIELD

The present invention relates to a shield shell.

BACKGROUND ART

Patent literature 1 has disclosed a constitution wherein a terminal of a tubular shielding member composed of a braided wire is connected with a shield case of an equipment via an electrically conductive and tubular shield shell. As this kind of shield shell, the one made of aluminum die-cast has been used, however, concerning weight gain, a shield shell made of a conductive resin obtained by incorporating a carbon fiber into a resin such as PBT has been considered as an alternative means.

[Patent literature 1]: Japanese Unexamined Patent Publication No. H10-241792

However, due to its large volume resistivity, it has been a problem for a conductive resin to show low shielding performance in a low-frequency region, and a countermeasure has been therefore expected. This invention has been completed based on the above circumstances, and its purpose is to improve the shielding performance in a low-frequency region.

As means for achieving the above-mentioned objects, a shield shell according to the present invention comprises: a shell body made of a conductive resin and having a tubular shape capable of surrounding an conductive path, in which a first end in both ends in the axial direction is rigidly fixed to a terminal of a tubular and flexible shielding member which surrounds the conductive path, while a second end in the both ends is attached to a shield case of an equipment; and a metallic conductive body provided in the shell body which in the first end of the shell body is exposed on the surface of the shell body so as to be connected with the shielding member, while in the second end of the shell body is exposed on the surface of the shell body so as to be connected with the shield case.

A shielding member and a shield case are connected via a metallic conductive body of a low electric resistance, and thereby achieving excellent shielding performance in a low-frequency region in a shield shell.

DESCRIPTION OF SYMBOLS

Figure 1:
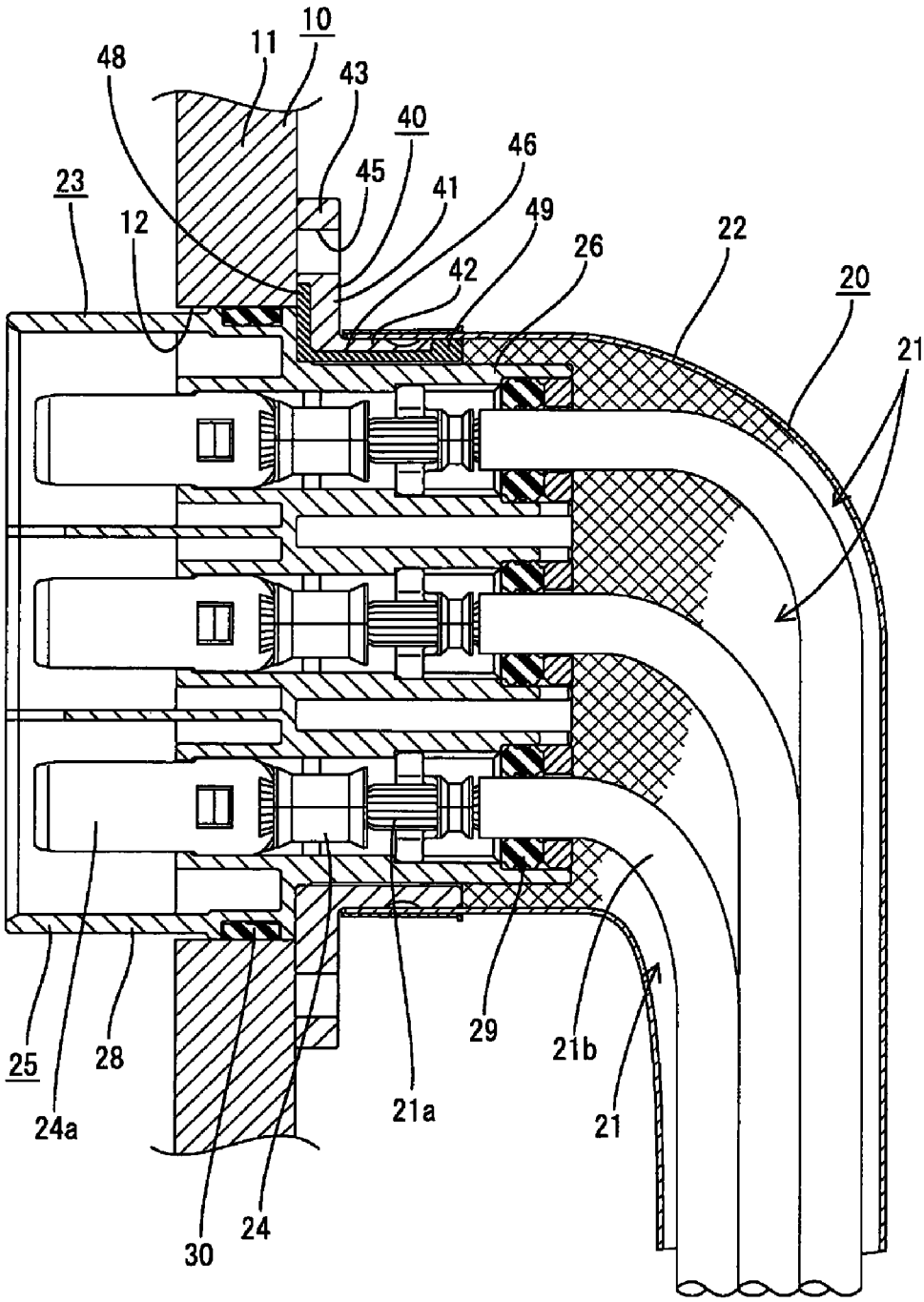
FIG. 1 is a cross-sectional view showing a state of a shield shell connected with a shielding member and a shield case in Embodiment 1.

10 . . . equipment (inverter device) 11 . . . shield case 21 . . . wire (conductive path) 22 . . . shielding member 24 . . . terminal (conductive path) 40 . . . shield shell 41 . . . shell body 46 . . . conductive body

BEST MODE FOR CARRYING OUT THE INVENTION

In what follows, as referring now to FIGS. 1 to 6, Embodiment 1 which materializes the present invention is described. The present embodiment is what is applied to a connecting part of a wire harness 20, which connects between an inverter device 10 (corresponding to an equipment) and a motor (not shown) in, for example, a hybrid vehicle.

As shown in FIG. 1, the inverter device 10 houses an inverter body not shown in a metallic shield case 11, while in the shield case 11, a mounting hole 12 of a horizontally long oval shape is formed as penetrating therethrough. And also, arranged in a position in the vicinity of the mounting hole 12 within the shield case 11 is a connector (not shown) in equipment side which is connected with the inverter body.

The wire harness 20 is constituted by comprising three wires 21 (corresponding to a conductive path) of a well-known structure formed by coating around a core wire 21*a* with an insulating coating 21*b*, a tubular shielding member 22 composed of a braided wire collectively covering across the entire length of the three wires 21, and a connector in harness side 23 of a triode type which is connected with the tip side (the side to be connected with an inverter device 10) of a group of the three wires 21.

The connector in harness side 23 is constituted by comprising a terminal 24 (corresponding to a conductive path) rigidly fixed to the tip of each wire 21, a connector housing 25 made of synthetic resin and housing three terminals 24, and a shield shell 40 surrounding the connector housing 25.

The connector housing 25 integrally forms a body part 26 in which three terminal housing members 27 of a nearly cylindrical shape are arranged and joined, with its axis line directed in the front and rear direction, so as to align in the right and left, and a hood part 28 of a horizontally long and nearly-oval shape that is protruding forward from the body part 26. The terminal 24 is inserted into each terminal housing member 27 from the rear side, while the wire 21 connected to the rear end of the terminal 24 is led out externally to the rearward of the body part 26. The clearance between the outer circumference of each wire 21 and the inner circumferential rear end of the terminal housing member 27 is liquid-tightly sealed with a tubular rubber plug 29. In addition, the led out part in these three wires 21 extending to the outside of the body part 26 are collectively surrounded with the shielding member 22 composed of a braided wire as mentioned above. A tab 24*a* on the front end of the terminal 24 protrudes forwardly from the front end surface (the back end surface of the hood part 28) of the body part 26, and the protruding three tabs 24*a* are collectively surrounded with the hood part 28. On the circumference of the hood part 28, a seal ring 30 is attached for sealing the clearance between the mounting hole 12 in the shield case 11 and the outer circumference of the connector housing 25.

The shield shell 40 is composed of a nearly-cylindrical shell body 41 made of a conductive resin and a conductive body 46 attached to the shell body 41.

The shell body 41 is made of what is obtained by mixing the electrically insulating PBT (polybutylene terephthalate) resin with a carbon fiber, and the mix rate of the carbon fiber is around 50%. Additionally, the mix rate of the carbon fiber may be accordingly changed. The shell body 41 is constituted by integrally forming a tubular part 42 having a horizontally long oval shape for allowing the body part 26 of the connector housing 25 to fit thereinto and a flange 43 projecting from across the whole circumference of the edge of the tip (corresponding to a second end part) of the tubular part 42. A caulking groove 44 is formed across the whole circumference of the base end part (corresponding to a first end part) positioned in the rear end side in the outer circumference of the tubular part 42. And also, a plurality of bolt holes 45 is formed in the flange 43 as penetrating therethrough in the front and rear direction.

Figure 2:
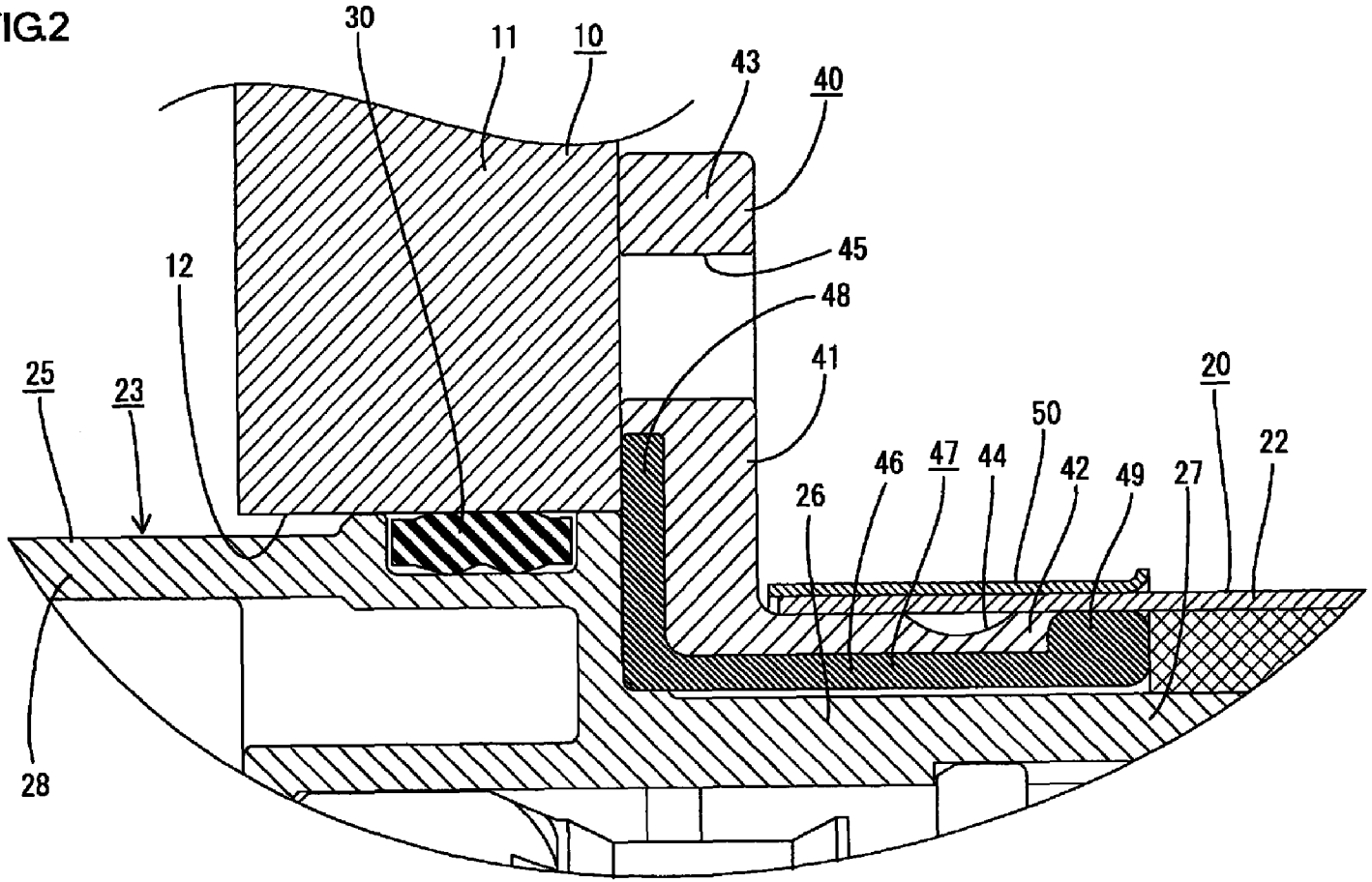
FIG. 2 is a partially enlarged view of FIG. 1.
Figure 3:
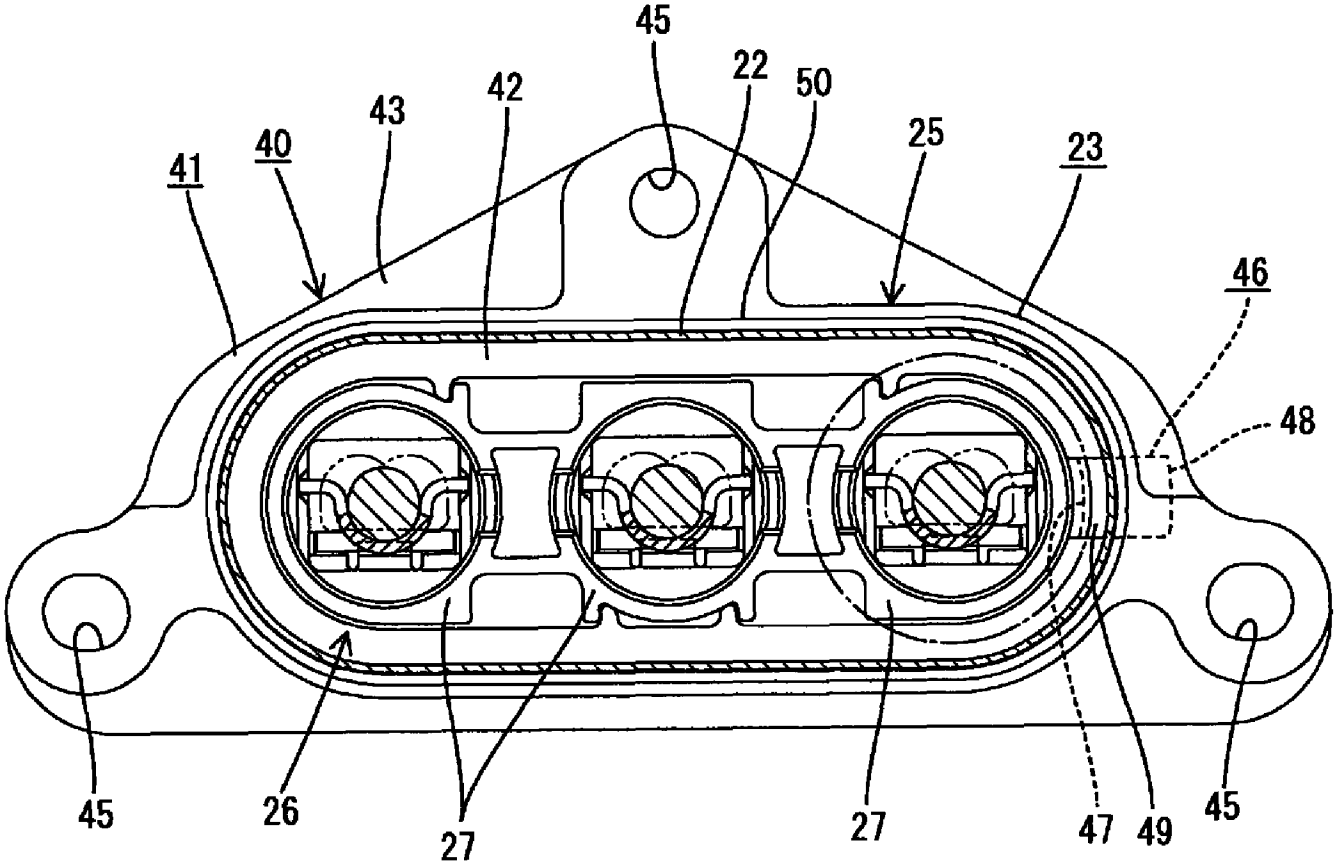
FIG. 3 is a back view.
Figure 4:
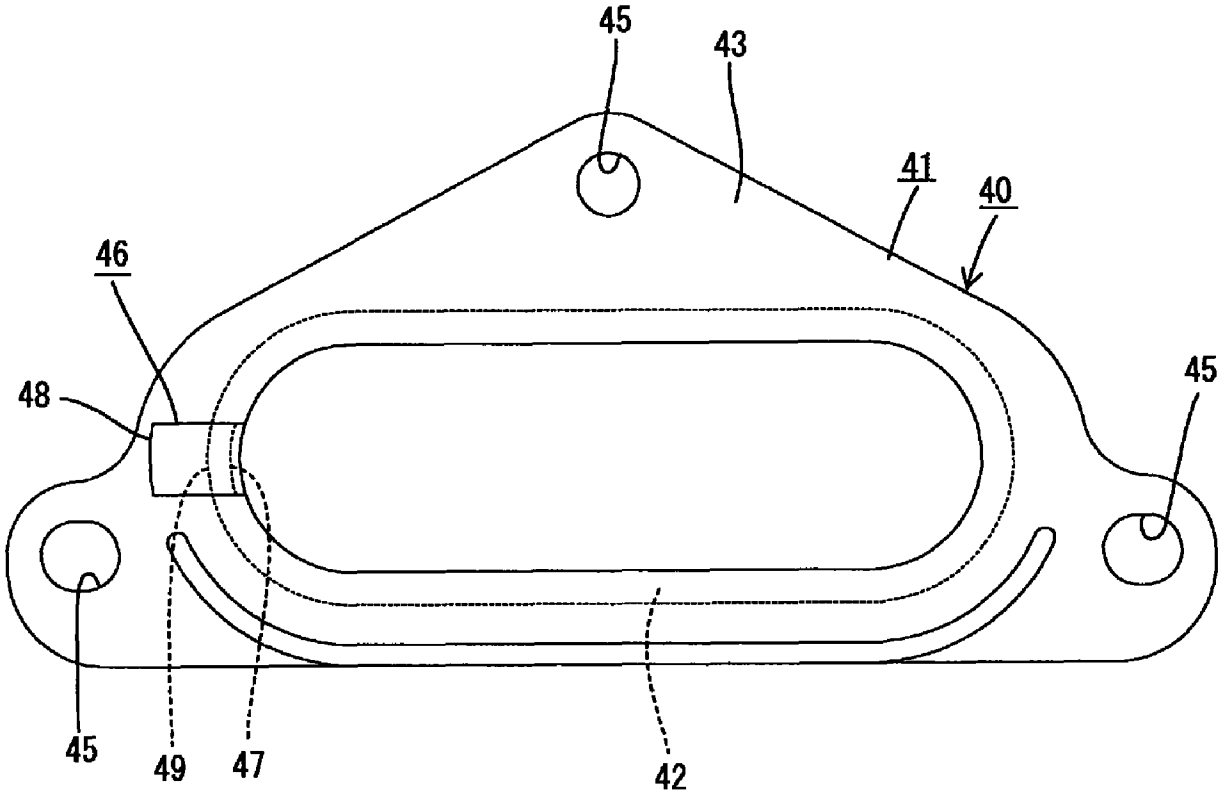
FIG. 4 is an elevation view of the shield shell.

As shown in FIG. 2, the conductive body 46 is made of a metal (for example, copper or copper alloy), and extending thin and long in the front and rear direction on the whole. In particular, the conductive body 46 is composed of a rod-like member 47 thin and long in the front and rear direction, a front connecting member 48 extending from the tip (the front end part) of the rod-like member 47 at nearly right angle, and a rear connecting member 49 as a regionally thick part of the external surface side of the base end part (the rear end part) of the rod-like member 47. The conductive body 46 according to the present embodiment is integrated by insert molding, when metallic molding the shell body 41, in such a way as to be buried in the shell body 41. The buried conductive body 46 is disposed in one semicircular arc part among both the right and left semicircular arc parts in the shell body 41. The inner surface and the front and rear end surfaces of the rod-like member 47 are respectively exposed on the inner circumferential surface and the front and rear end surfaces of the semicircular arc part, with its outer surface covered with the shell body 41. And also, as shown in FIG. 4, the front surface of the front connecting member 48 is exposing to the front surface of the flange 43, in other words, to a surface opposing to the external wall surface of the shield case 11, and this exposing surface is the surface contacting with the shield case 11 The rear surface of the front connecting member 48 is covered with the flange 43. As shown in FIG. 3, the outer surface of the rear connecting member 49 is exposing to the outer circumferential surface of the semicircular arc part (the shell body 41), and this exposing surface is the surface contacting with the shielding member 22. The rear connecting member 49 is arranged in the rear side (the base end side) of the caulking groove 44.

The front end of the shielding member 22 is electrically and conductively connected with the above-mentioned rear end part (the base end part) of the tubular part 42. The connecting method is to externally fit the shielding member 22 to the entire area including the caulking groove 44 and the rear connecting member 49 in the outer circumference of the tubular part 42, and further to the external circumference thereof, to externally fit a caulking ring 50 of an oval shape, so that the caulking ring 50 is deformed in diameter reduction as being caulked. This caulking enables the shielding member 22 to be rigidly held and fixed between the caulking ring 50 and the tubular part 42 and be directly and electrically conductively connected with the outer surface of the rear connecting member 49.

Since three wires 21 are previously inserted into the tubular part 42 in the shield shell 40, after connecting the shielding member 22 with the shield shell 40, the body part 26 in the connector housing 25 is fitted to the tubular part 42 from the front. Then, in a fitted state of the shield shell 40 and the connector housing 25, the hood part 28 of the connector is externally fitted into the mounting hole 12 in the inverter device 20. In the fitted state into the mounting hole 12, the seal ring 30 attached to the outer circumference of the hood part 28 liquid-tightly seals the clearance between the outer circumference of the hood part 28 and the inner circumference of the mounting hole 12. After that, screwing and tightening a bolt (not shown) in the bolt hole 45 into a female screw hole (not shown) in the shield case 11 completes this mounting work to the shield case 11. In the completed state of the mounting, the front connecting member 48 is directly and electrically conductively contacting with the external wall surface of the shield case 11. This allows the front end of the shielding member 22 and the shield case 11 to be electrically conductively connected by the conductive body 46. In addition, the tip of the shell body 41 is electrically connected with the shield case 11.

Accordingly, the conductive path from the terminal part of the wire 21 to the terminal 24 is shielded by the shielding member 22, the shield shell 40, and the shield case 11. A shielding means for shielding a high-frequency region does not interfere with the shielding effect even if it has a large electrical resistance (volume resistivity), however, is required to surround across the whole conductive path. In this regard, according to the present embodiment, the shell body 41 made of a conductive resin is surrounding across the entire terminal 24, and thus develops a high shielding effect in a high-frequency region. On the other hand, a shielding means for shielding a low-frequency region is not necessarily required to surround across the whole conductive path, however, is required to have a small electrical resistance (volume resistivity). In this regard, according to the present embodiment, the metallic conductive body 46 is used, and thus develops a high shielding effect in a low-frequency region.

Figure 5:
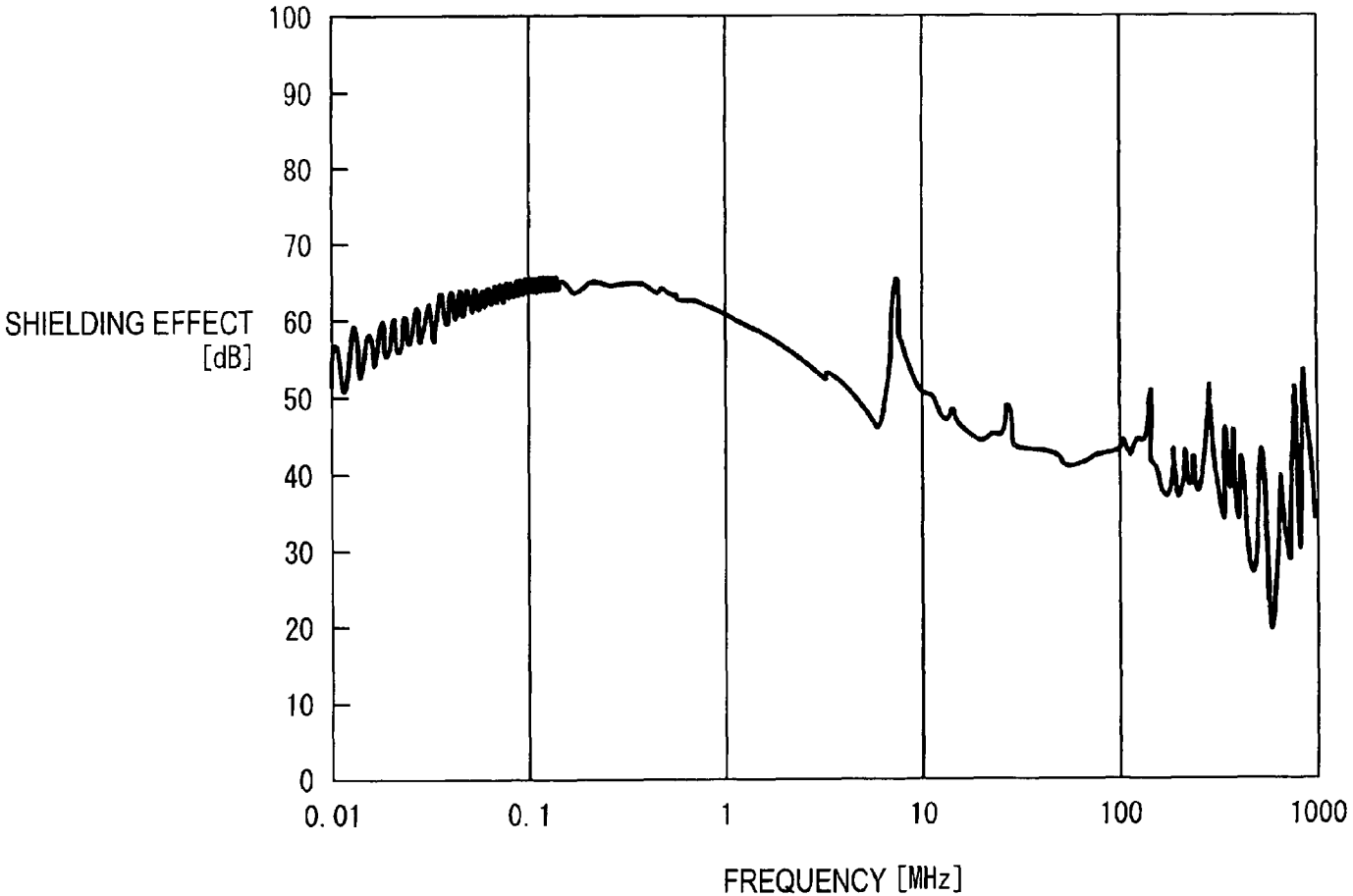
FIG. 5 is a graph showing the shielding performance of Embodiment 1.
Figure 6:
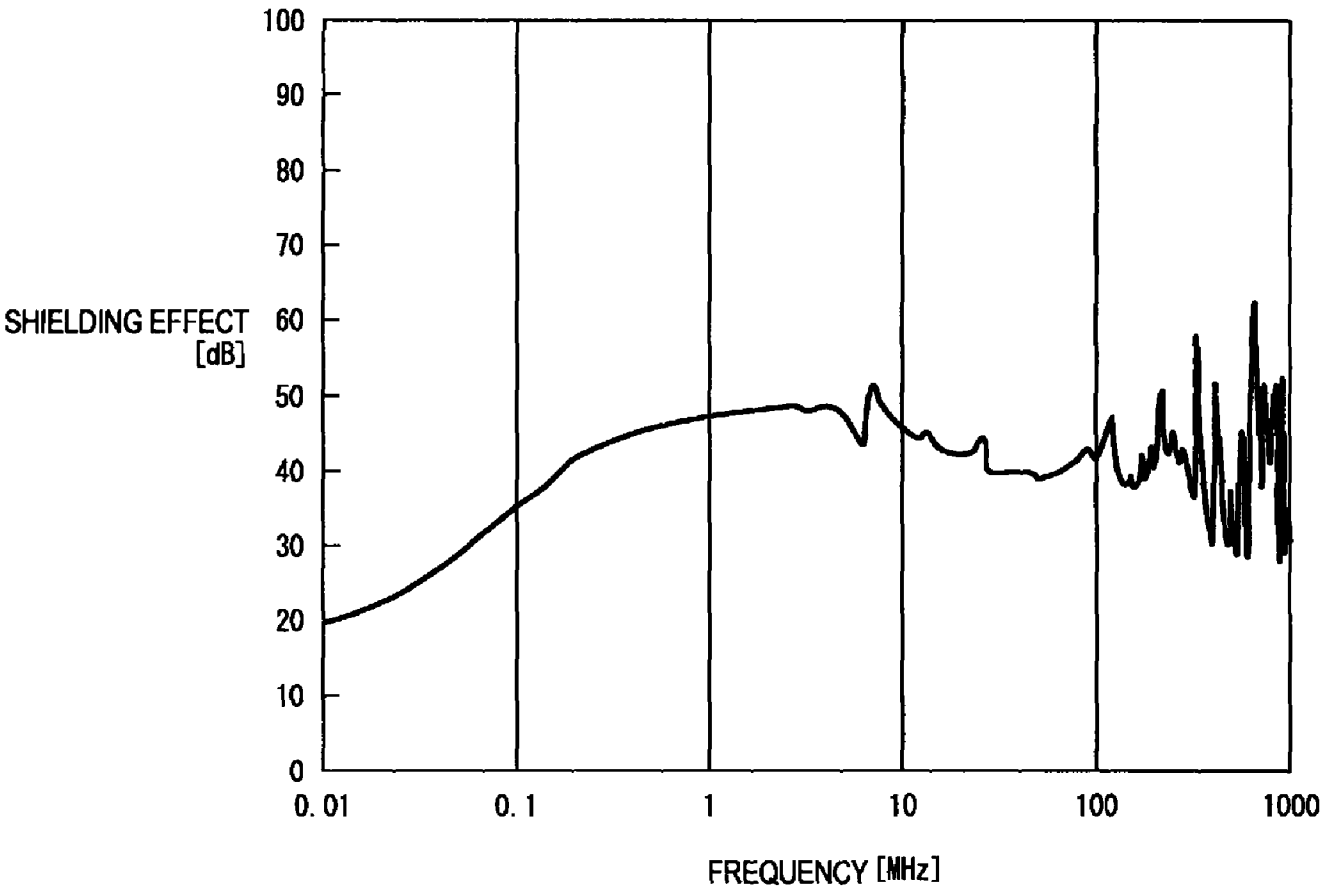
FIG.6 Prior Art
FIG. 6 is a graph showing the shielding performance of a conventional example.

FIGS. 5 and 6 show in graphs the experimental result of examining the shielding effect in a low-frequency region when the conductive body 46 is used. FIG. 6 shows the shielding performance by frequency of a shielding means that is composed of a tubular conductive resin having PBT resin incorporated with 50% of carbon fiber, and not provided with a means corresponding to the conductive body 46 in the present embodiment. In the graph, as the value in the longitudinal axis increases, the shielding performance becomes higher. According to this shielding means, in a region of frequency of lower than 10 MHz, it can be seen that as the frequency lowers, the shielding effect is reduced.

On the other hand, FIG. 5 shows the shielding performance by frequency of a shielding means composed of a tubular conductive resin having PBT resin incorporated with 50% of carbon fiber, with a copper tape attached thereto. One end of the copper tape is directly connected with the shielding member 22, while the other end is directly connected with the shield case 11. According to the graph in FIG. 5, it can be seen that the shielding means with this copper tape attached thereto develops a high shielding performance even in the frequency region of lower than 10 MHz.

As mentioned, the shield shell 40 according to the present embodiment is constituted by providing the tubular shell body 41 made of a conductive resin with the metallic conductive body of low electrical resistance, wherein the shielding member 22 and the shield case 11 are connected by this conductive body 46, thereby developing an excellent shielding performance in a low-frequency region.

In addition, the conductive body 46 extends thin and long from the base end part of the shield shell 40 toward the tip thereof, so that reduction in weight and cost can be expected as compared to the tubular conductive body 46. Additionally, the shielding performance in a low-frequency region may be sufficiently developed when the electrical resistance is low, even without cylindrically surrounding the conductive path (the terminal 24) arranged inside the shield shell 40, and the conductive body 46 does not therefore interfere with the shielding performance in a low-frequency region even if it has a long and thin shape.

And also, the connecting end of the conductive body 46 with the shielding member 22 is constituted so as to be exposed on the outer circumferential surface of the shell body 41, and the shielding member 22 can therefore be connected with the conductive body 46 by capping the base end part of the shell body 41. The shielding member 22 being put on the outer circumference of the shell body 41 in this manner simplifies the connecting work with the shielding member 22, as compared with connecting with the shielding member 22 in the inner circumference side of the shell body 41.

Embodiment 2

Figure 7:
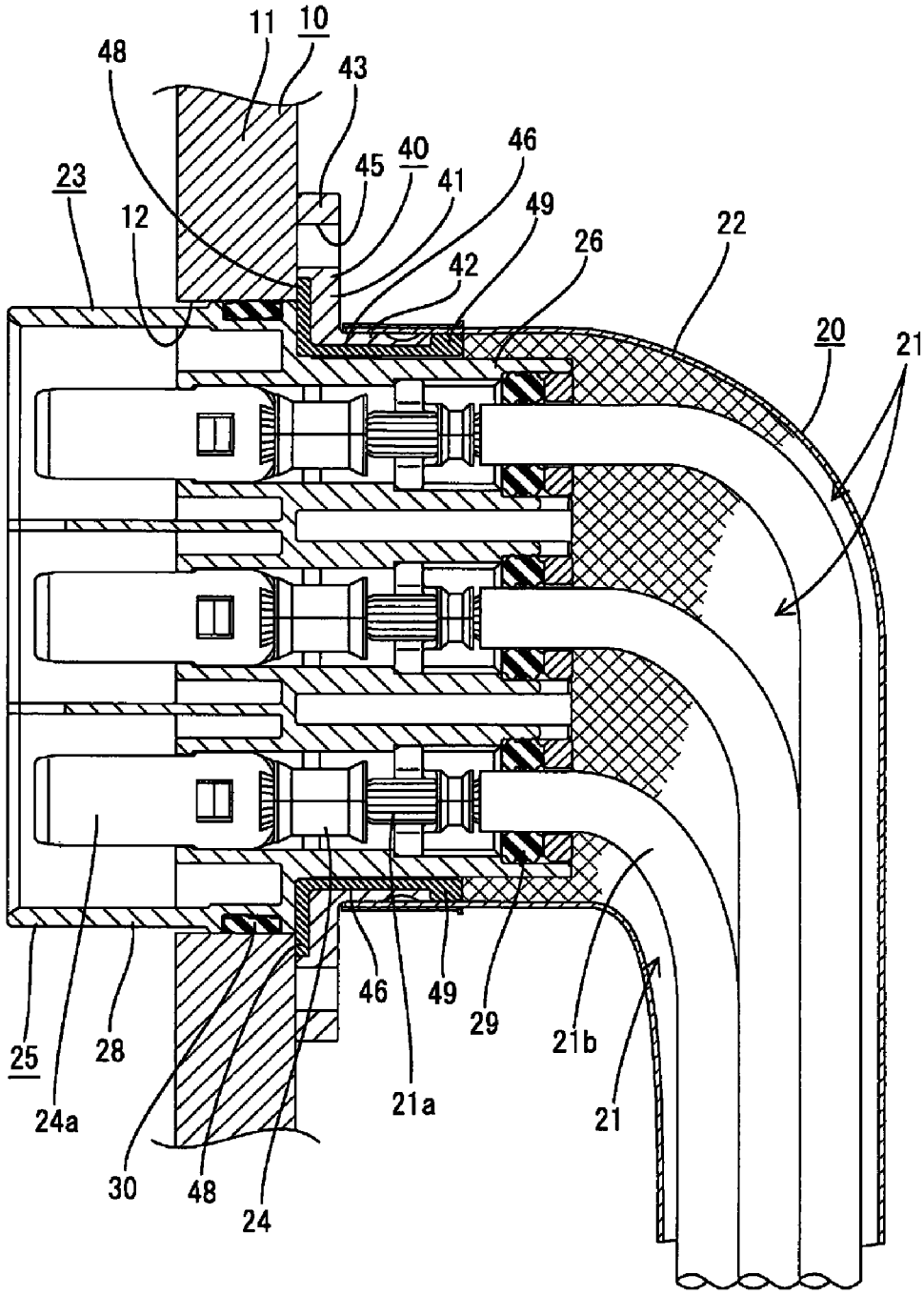
FIG. 7 is a cross-sectional view showing a shield shell according to Embodiment 2.
Figure 8:
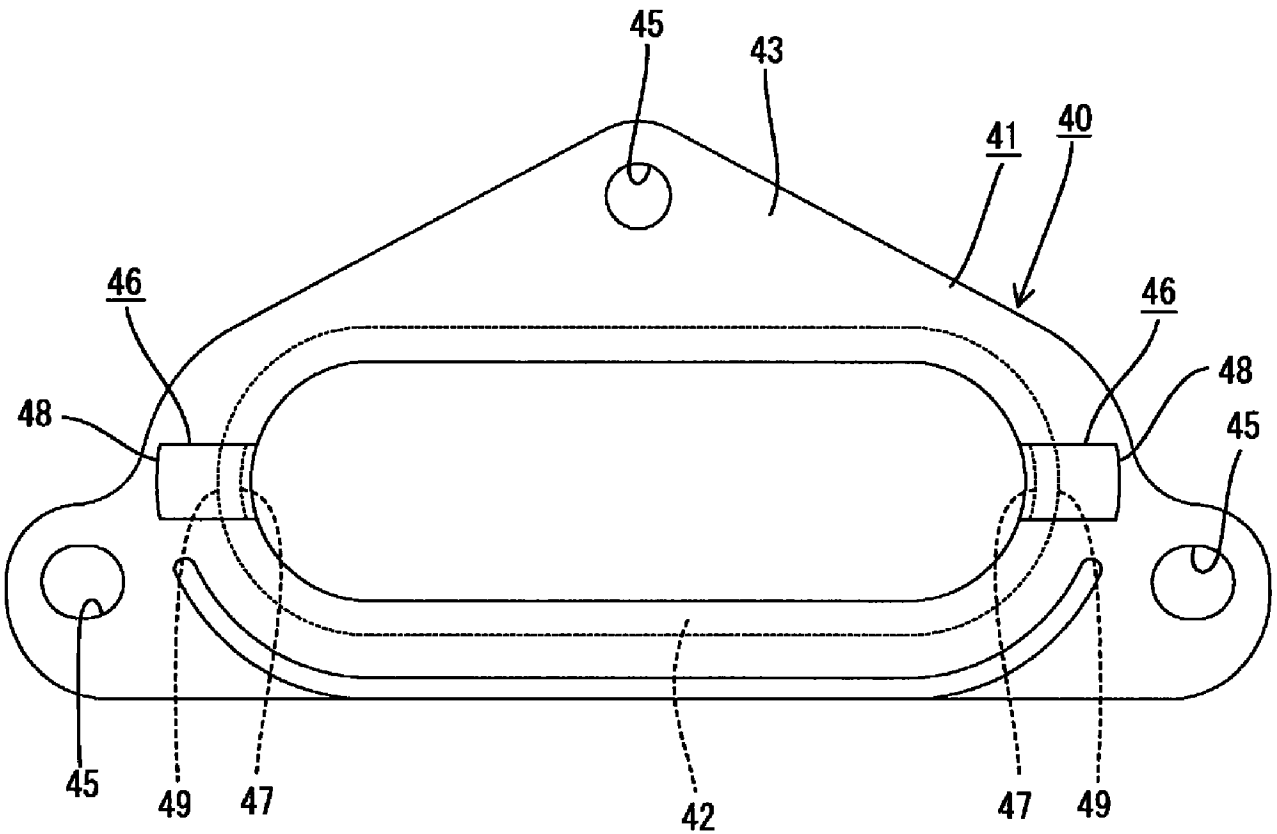
FIG. 8 is an elevation view of the shield shell.

As shown in FIGS. 7 and 8, according to the present embodiment, a pair of conductive bodies 46 is arranged in both the right and left semicircular arc parts in the shell body 41. The pair of conductive bodies 46 is disposed in positions symmetrical to the axis of the tubular part 42 in the shell body 41. In other words, the pair of conductive bodies 46 is arranged in the shell body 41 symmetrically in vertical direction in FIG. 7, while being arranged symmetrically in the right and left direction in FIG. 8.

The configurations other than the above are nearly the same as Embodiment 1, and thus, the same numerals are allotted to the same members for omitting repetitive descriptions.

According to the present embodiment, a pair of conductive bodies 46 is arranged so that the shielding performance in a low-frequency region can be further improved.

Embodiment 3

Figure 9:
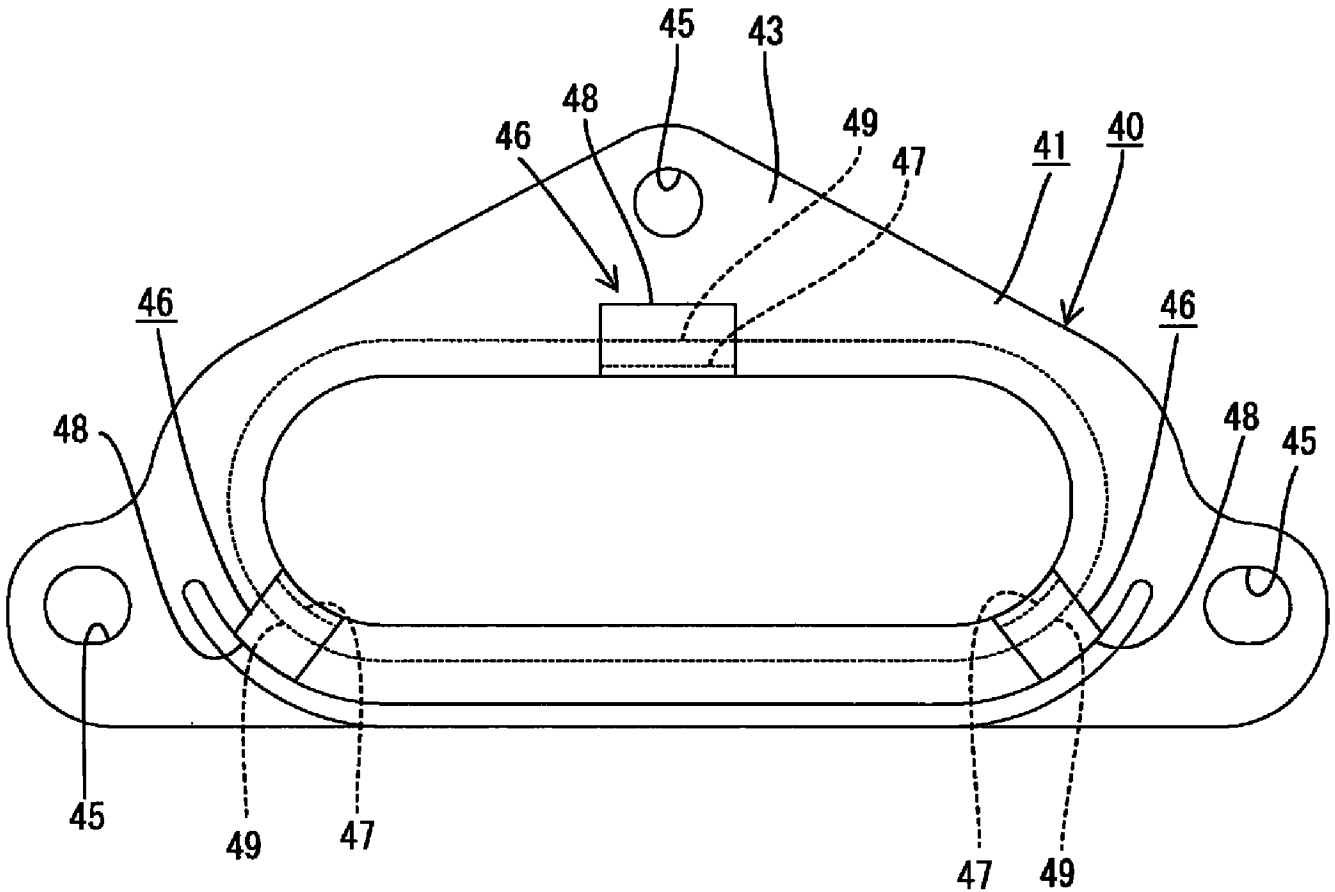
FIG. 9 is an elevation view of a shield shell according to Embodiment 3.

As shown in FIG. 9, according to the present embodiment, three conductive bodies 46 are arranged in the positions slightly closer to the bottom in both the right and left semicircular arc parts of the shell body 41 and in a position in the upper part of the shell body 41. Three conductive bodies 46 are symmetrically arranged in the right and left direction in FIG. 9.

The configurations other than the above are nearly the same as Embodiment 1, and thus, the same numerals are allotted to the same members for omitting repetitive descriptions.

According to the present embodiment, three conductive bodies 46 are arranged so that the shielding performance in a low-frequency region can be further improved.

Comparison of Shielding Performances

Figure 10:
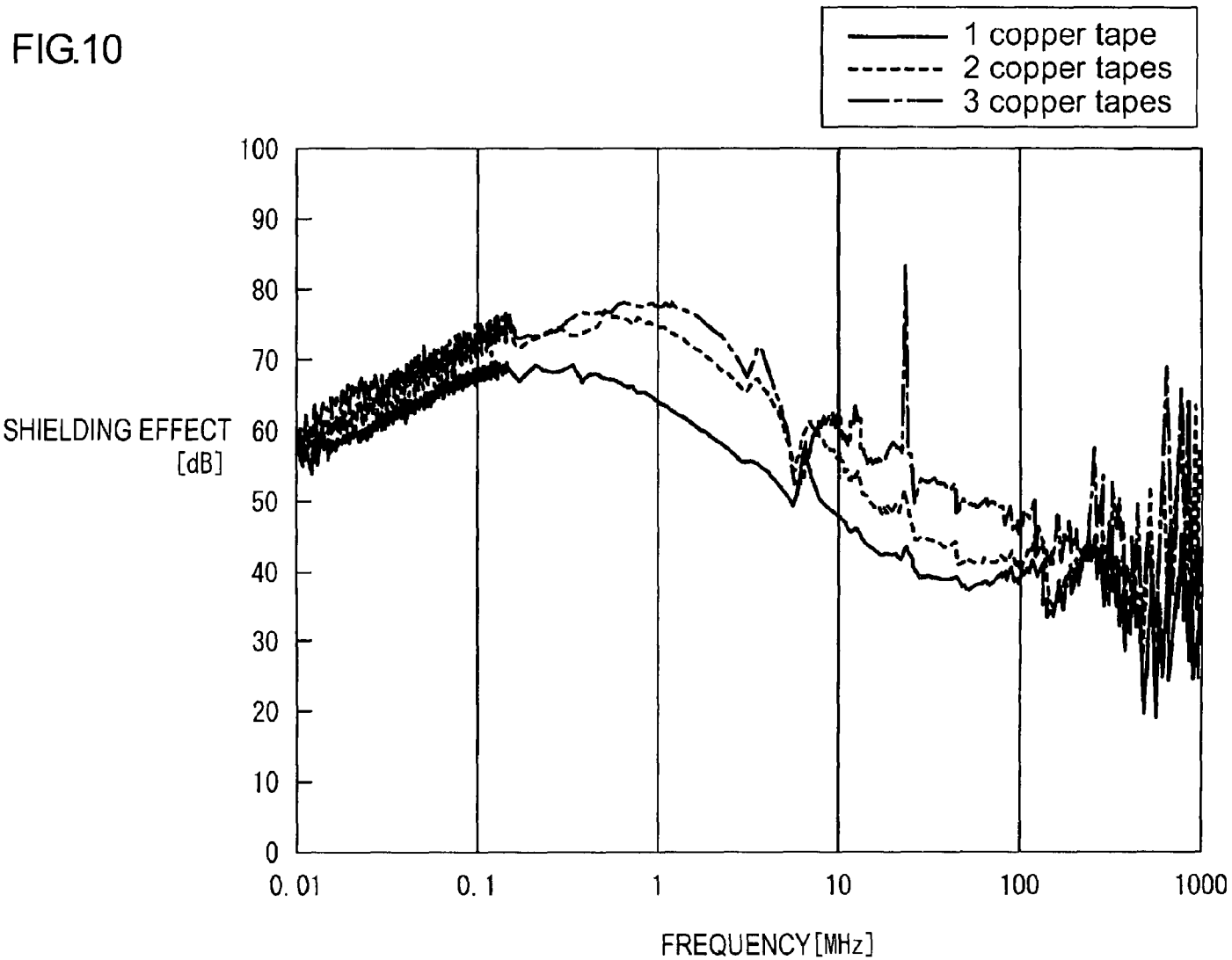
FIG. 10 is a graph showing the shielding performance of a shielding means having a copper tape adhered thereto.

FIG. 10 shows the change in shielding performance relative to the frequency of a shielding means constituted by attaching one to three copper tapes to the tubular conductive resin having the PBT resin incorporated with 30% of carbon fiber. In FIG. 10, one with one copper tape attached to the conductive resin is shown with a straight line, one with two copper tapes attached is shown with a dashed line, and one with three copper tapes attached is shown with a dashed-dotted line.

As shown in the graph of FIG. 10, in a frequency region lower than 10 MHz, the shielding performance of the shielding means becomes more improved as the number of the attached copper tape increases.

In addition, also in the region of 10 MHz to 100 MHz, it can be seen that the shielding performance becomes more improved as the number of the attached copper tape increases.

Other Embodiments

With embodiments of the present invention described above with reference to the accompanying drawings, it is to be understood that the invention is not limited to those precise embodiments, and the embodiments as below, for example, can be within the scope of the present invention.

(1) The conductive body is not limited to a rod shape, and may be a cylindrical shape. In this case, a shape of covering the outer circumferential surface of the shell body, covering the inner circumferential surface of the shell body, and burying the conductive body other than its both ends in the axial direction into the inner side of the shell body may be possible.

(2) Means for mounting the conductive body to the shell body is not limited to the insert molding, and the conductive body and the shell body that are manufactured separately may be fitted. This fitting method can be employed for conductive bodies of any configurations and shapes.

(3) The conductive body is not limited to those without flexibility, and may be the one, with a flexible and metallic (for example, copper) tape or sheet attached to the surface of the shell body.

(4) A plurality of conductive bodies more than four may be provided in one shell body.

(5) In the above embodiments, the case where the housing having the terminal mounted therein is fitted inside the shield shell was described, however, the present invention may also be applied to a case where the terminal part of the wire penetrating through the shield shell is connected to the terminal clamp in the shield case, without housing the housing within the shield shell.

Figure 11:
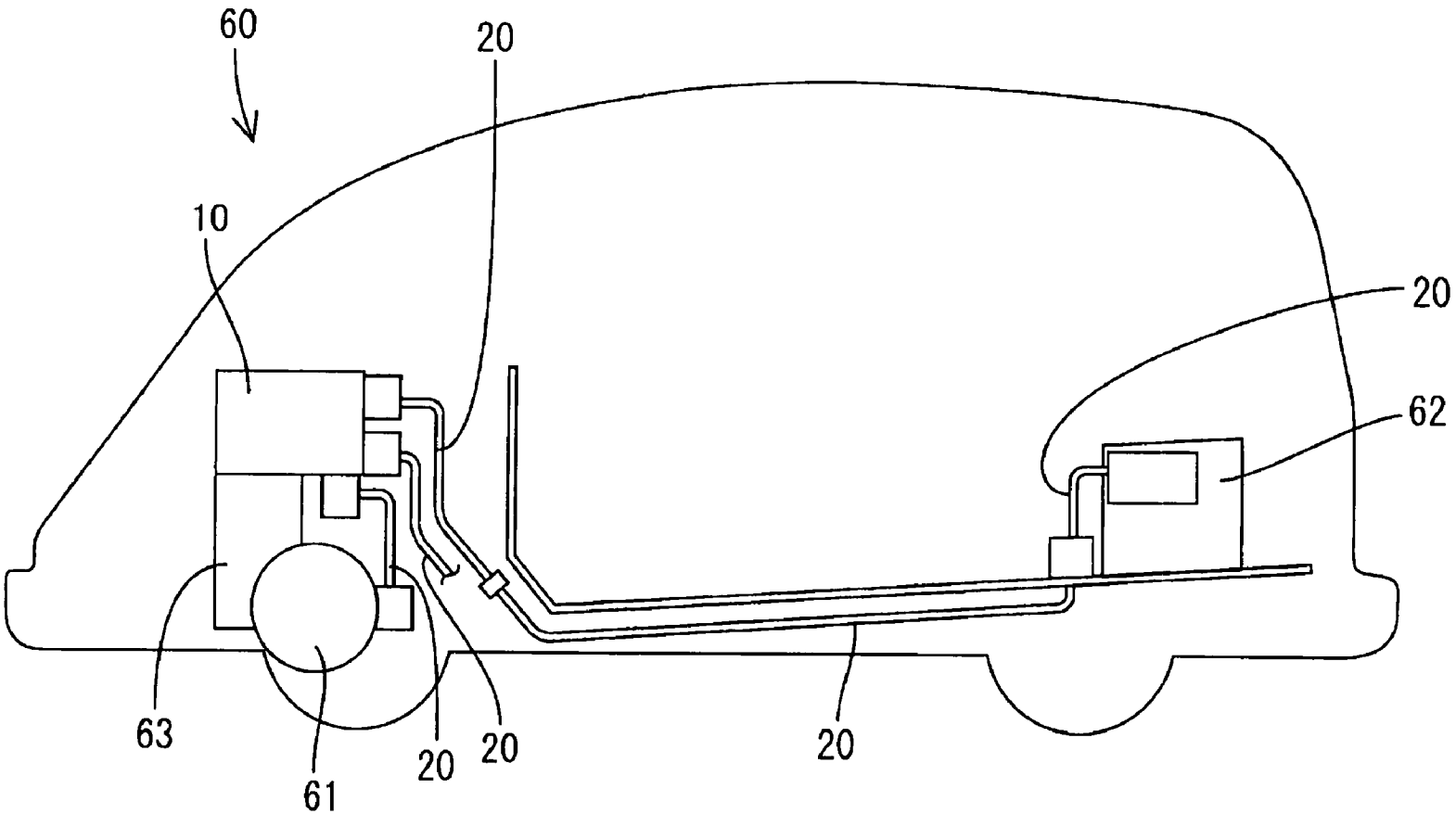
FIG. 11 is a pattern diagram showing a vehicle mounted with a wire harness including a shield shell.

(6) FIG. 11 shows a configuration of the shield shell 40 according to the present invention mounted in a hybrid vehicle (corresponding to a vehicle) 60. The hybrid vehicle 60 is mounted with a battery 62, an inverter device 10, a motor 61, and an engine 63 all connected with the wire harness 20. The shield shell 40 may be applied to the connecting part of the wire harness 20 that connects the inverter device 10 and the motor 61. The direct current from the battery 62 is converted into a three-phase alternating current by the inverter device 10 and then applied to the motor 61. The shield shell 40 may be applied to the connecting part of the wire harness 20 accordingly if needed.

(7) The conductive body is not limited to copper or copper alloy, and may be made of an arbitrary metal such as stainless steel, aluminum, or aluminum alloy when needed.

(8) A plurality of the conductive bodies may not be necessarily positioned symmetrically, and may be disposed in arbitrary positions when needed.

(9) The shield shell may be applied to the wire harness mounted in an electric vehicle.

The invention claimed is:

1. A shield shell, comprising:

a shell body made of a conductive resin and extending in an axial direction so as to form a tubular shape capable of surrounding a conductive path, the shell body having a first end and a second end in the axial direction and an outer circumferential surface, the first end being rigidly fixed to a terminal of a tubular and flexible shielding member which surrounds the conductive path, the second end being attached to a shield case of an equipment;

a metallic conductive body provided in the shell body in which the outer circumferential surface of the shell body at the first end of the shell body is exposed so as to be connected with the shielding member, while the outer circumferential surface of the shell body at the second end of the shell body is exposed so as to be connected with the shield case, wherein a connecting part with the shielding member in the conductive body is exposed on the outer circumferential surface.

2. The shield shell according to claim 1 wherein the conductive path is configured to supply an electric power for motive power of a vehicle.

3. The shield shell according to claim 2 wherein the conductive path configured to connect an inverter device and a motor mounted in the vehicle.

4. The shield shell according to claim 3 wherein the conductive body extends thin and long from the first end to the second end.

5. The shield shell according to claim 1, wherein the shell body is provided with a plurality of conductive bodies.

* * * * *